US008836738B2

(12) United States Patent
Yokoyama et al.

(10) Patent No.: US 8,836,738 B2
(45) Date of Patent: Sep. 16, 2014

(54) DRIVE CONTROL METHOD FOR A MEDIA PROCESSING DEVICE, AND A MEDIA PROCESSING SYSTEM

(75) Inventors: Yasufumi Yokoyama, Matsumoto (JP); Shoji Shima, Shiojiri (JP); Koji Hashimoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 195 days.

(21) Appl. No.: 13/177,052

(22) Filed: Jul. 6, 2011

(65) Prior Publication Data

US 2012/0007932 A1 Jan. 12, 2012

(30) Foreign Application Priority Data

Jul. 6, 2010 (JP) ..... 2010-153673

(51) Int. Cl.
*B41J 2/00* (2006.01)
*B41J 2/165* (2006.01)
*B41J 3/407* (2006.01)

(52) U.S. Cl.
CPC ..... *B41J 2/165* (2013.01); *B41J 3/4071* (2013.01)
USPC ..... 347/110; 347/23

(58) Field of Classification Search
CPC ..... B41J 2/165; B41J 3/4075
USPC ..... 347/110, 22, 23, 105
See application file for complete search history.

(56) References Cited

U.S. PATENT DOCUMENTS

| | | | | |
|---|---|---|---|---|
| 6,400,659 | B1 | 6/2002 | Kitaoka | |
| 2002/0171702 | A1 * | 11/2002 | Kobayashi et al. | 347/19 |
| 2003/0063142 | A1 * | 4/2003 | Sakamoto et al. | 347/5 |
| 2003/0122891 | A1 * | 7/2003 | Hamamoto et al. | 347/23 |
| 2008/0218551 | A1 * | 9/2008 | Inaba | 347/23 |
| 2009/0086004 | A1 * | 4/2009 | Maeshima | 347/110 |

FOREIGN PATENT DOCUMENTS

JP 2000-260172 A 9/2000

* cited by examiner

*Primary Examiner* — Thinh Nguyen
*Assistant Examiner* — Alexander C Witkowski
(74) *Attorney, Agent, or Firm* — Nutter McClennen & Fish LLP; John J. Penny, Jr.

(57) ABSTRACT

A drive control method for a media processing device prevents increasing the media production time even when a printhead cleaning process is performed before the printing process. When a media production command is input, the preprocessing time required until the printing process starts is calculated based on the media production command. If the total of the preprocessing time plus the time passed since the last cleaning process is greater than or equal to a specified time, the cleaning process is started. If the elapsed time will reach the specified time after the media production command is output and before the printing process starts, the cleaning process runs parallel to the write process. Increasing the media production time by the time required for the cleaning process is thus prevented.

9 Claims, 5 Drawing Sheets

DRIVE CONTROL METHOD FOR A MEDIA PROCESSING DEVICE, AND A MEDIA PROCESSING SYSTEM

BACKGROUND

1. Technical Field

The present invention relates to a media processing device that performs a preprocessing operation such as capturing image data with a scanner or writing data to a medium before printing on the medium with a printhead. More particularly, the invention relates to a drive control method for a media processing device that does not increase the media production time even when a printhead cleaning process is performed before a printing process starts.

2. Related Art

Disc duplicators and other types of media processing devices have a media writing mechanism (media writer) for writing data to CDs, DVDs, and similar media, and a printing mechanism (printer) that uses a printhead to print a label on the label side of the medium. When a media production command is input, the data write process of the media writer and the label printing process of the printer are executed sequentially to produce a new disc. To avoid a drop in print quality when printing the label due to clogged ink nozzles, the disc duplicator runs a cleaning process to clean the printhead of the printing mechanism at specified times whenever a certain time interval has passed. Japanese Unexamined Patent Appl. Pub. JP-A-2000-260172 describes a printer that runs a cleaning process as an interrupt process at the start of the first printing process when a specified time has passed after the last cleaning process.

When the media processing device executes the printhead cleaning process as an interrupt process at the start of the first printing process executed a specified time after the last cleaning process, the time since the last cleaning process could reach this specified time while the write process is executing. In this case, the cleaning process is performed after the write process ends, and the printing process waits until the cleaning process ends. As a result, the actual media production time is increased by the amount of time required for the cleaning process. If the cleaning process is not performed in this case, the print quality of the label may drop.

SUMMARY

A drive control method for a media processing device according to the invention does not increase the media production time even when a printhead cleaning process is performed before the printing process. A media processing device and a media processing system according to the invention use this drive control method to clean the printhead.

A first aspect of the invention is a drive control method for a media processing device that produces media when a media production command is input by sequentially executing a first process not accompanied by a printing operation that prints on media by means of a printhead, then executing a second process accompanied by the printing operation, the drive control method including steps of: calculating a preprocessing time, which is the time until the second process starts, based on the media production command when the media production command is input; calculating a total time as the sum of the preprocessing time and the time elapsed since the last cleaning process performed on the printhead; determining if the total time is greater than or equal to a preset specified time at which a new cleaning process is necessary; and starting the cleaning process if the total time is greater than or equal to the specified time.

When a media production command is input in this aspect of the invention, a preprocessing time, which is the time until the second process starts, is calculated based on the media production command. If the total of the preprocessing time plus the time elapsed since the last cleaning process performed on the printhead is greater than or equal to a preset specified time at which a new cleaning process is necessary, the cleaning process starts. The cleaning process will therefore not be performed as an interrupt process after the first process ends because the first process and the cleaning process run at the same time if the time passed since the last cleaning process will reach the specified time after the media production command is input and before the second process starts. Because delaying the start of the second process by the time required for the cleaning process is thus avoided, increasing the media production time by the time required for the cleaning process can be prevented.

In another aspect of the invention, the drive control method preferably also has a step of: calculating and reporting a media production time, which is the time required to produce the media based on the media production command, to an operator when the media production command is input.

This aspect of the invention eliminates increasing the media production time by the time required for the cleaning process, and the difference between the media production time calculated from the media production command and the actual time required to produce and output the media is therefore small. The media production time can therefore be accurately reported to the operator.

In a drive control method according to another aspect of the invention, the first process preferably the first process includes a write process that writes data to the media; and the second process includes a printing process that prints a label on the media.

In a drive control method according to another aspect of the invention, the first process includes a read process that reads image data by means of a scanner; and the second process includes a printing process that prints on the media based on the scanned image data.

Further preferably, when the media processing device is communicably connected to a computer as part of a media processing system, the media production command is input to the computer; the preprocessing time is calculated and the media production command and the preprocessing time are supplied to the media processing device by the computer; and the media processing device calculates and determines if the total time is greater than or equal to the specified time.

Another aspect of the invention is a media processing system including: a media processing device that has a write mechanism for executing a write process to write data on media, and a printing mechanism for executing a printing process to print a label on the media by means of a printhead, and sequentially executes and applies the write process and then the printing process to the media when a media production command is received; a computer that is communicably connected to the media processing device; and a software application that runs on the computer and receives the media production command; the software application including a preprocessing time calculation unit that, when the media production command is input, calculates a preprocessing time to when the printing process starts, and a transmission unit that sends the media production command and preprocessing time to the media processing device after the preprocessing time is calculated; and the media processing device including a cleaning mechanism for performing a cleaning process that cleans the printhead, a counting unit that counts elapsed time from completion of the cleaning process every time the cleaning process is performed, a total time calculation unit that calculates a total time as the sum of the elapsed time and the preprocessing time when the preprocessing time is received, a decision unit that, after the total time is calculated, determines if the total time is greater than or equal to a preset specified time at which the cleaning process is required, and a cleaning control unit that controls driving the cleaning mechanism, and starts the cleaning process if the total time is determined to be greater than or equal to the specified time.

When the media production command is input to the software application in this aspect of the invention, the software application calculates and sends a preprocessing time, which is the time required until the printing process starts, to the media processing device. The media processing device receives this preprocessing time, and starts the cleaning process if the total time, which is the sum of the elapsed time and the preprocessing time, is greater than or equal to a specified time. The write process and the cleaning process therefore run at the same time if the time passed since the last cleaning process will reach the specified time after the media production command is input and before the printing process starts, and the cleaning process will not be run as an interrupt process after the write process ends. Because delaying the start of the printing process by the time required for the cleaning process is thus avoided, increasing the media production time by the time required for the cleaning process can be prevented.

In a media processing system according to another aspect of the invention, the software application preferably includes a media production time notification unit that calculates a media production time required to produce the media when the media production command is input, and reports the media production time to an operator.

Because this aspect of the invention can prevent increasing the media production time by the time required for the cleaning process, the difference between the media production time calculated from the media production command and the actual time required to produce and output the media is small. The media production time reporting unit can therefore accurately report the media production time to the operator.

Another aspect of the invention is a media processing system including: a media processing device that has a write mechanism for executing a write process to write data on media, and a printing mechanism for executing a printing process to print a label on the media by means of a printhead, and sequentially executes and applies the write process and then the printing process to the media when a media production command is received; a computer that is communicably connected to the media processing device; a software application that runs on the computer and receives the media production command; and a software driver that runs on the computer and controls driving the media processing device based on the media production command; the software application including a first transmission unit that sends the media production command to the software driver when the media production command is input; the software driver including a preprocessing time calculation unit that, when the media production command is received, calculates a preprocessing time to when the printing process starts based on the media production command, and a second transmission unit that sends the media production command and the preprocessing time to the media processing device after the preprocessing time is calculated; and the media processing device including a cleaning mechanism for performing a cleaning process that cleans the printhead, a counting unit that counts elapsed time from completion of the cleaning process every time the cleaning process is performed, a total time calculation unit that calculates a total time as the sum of the elapsed time and the preprocessing time when the preprocessing time is received, a decision unit that, after the total time is calculated, determines if the total time is greater than or equal to a preset specified time at which the cleaning process is required, and a cleaning control unit that controls driving the cleaning mechanism, and starts the cleaning process if the total time is determined to be greater than or equal to the specified time.

When the media production command is input to the software application in this aspect of the invention, the media production command is passed to the software driver and the software driver calculates and sends a preprocessing time, which is the time required until the printing process starts, to the media processing device. The media processing device receives this preprocessing time, and starts the cleaning process if the total time, which is the sum of the elapsed time and the preprocessing time, is greater than or equal to a specified time. The write process and the cleaning process therefore run at the same time if the time passed since the last cleaning process will reach the specified time after the media production command is input and before the printing process starts, and the cleaning process will not be run as an interrupt process after the write process ends. Because delaying the start of the printing process by the time required for the cleaning process is thus avoided, increasing the media production time by the time required for the cleaning process can be prevented.

In another aspect of the invention, the software driver includes a media production time notification unit that calculates a media production time required to produce the media based on the media production command when the media production command is input, and reports the media production time to an operator. Because this aspect of the invention can prevent increasing the media production time by the time required for the cleaning process, the difference between the media production time calculated from the media production command and the actual time required to produce and output the media is small. The media production time reporting unit can therefore accurately report the media production time to the operator.

Effect of the Invention

When a media production command is input in this aspect of the invention, a preprocessing time, which is the time until the second process starts, is calculated based on the media production command. If the total of the preprocessing time plus the time elapsed since the last cleaning process performed on the printhead is greater than or equal to a preset specified time at which a new cleaning process is necessary, the cleaning process starts. Therefore, if the time passed since the last cleaning process will reach the specified time after the media production command is input and before the second process starts, the first process and the cleaning process run at the same time and the cleaning process will not be performed as an interrupt process after the first process ends. Because delaying the start of the second process by the time required for the cleaning process is thus avoided, increasing the media production time by the time required for the cleaning process can be prevented.

Other objects and attainments together with a fuller understanding of the invention will become apparent and appreciated by referring to the following description and claims taken in conjunction with the accompanying drawings.

DESCRIPTION OF EMBODIMENTS

A media processing system according to a preferred embodiment of the present invention is described below with reference to the accompanying figures.

General Configuration

Figure 1:
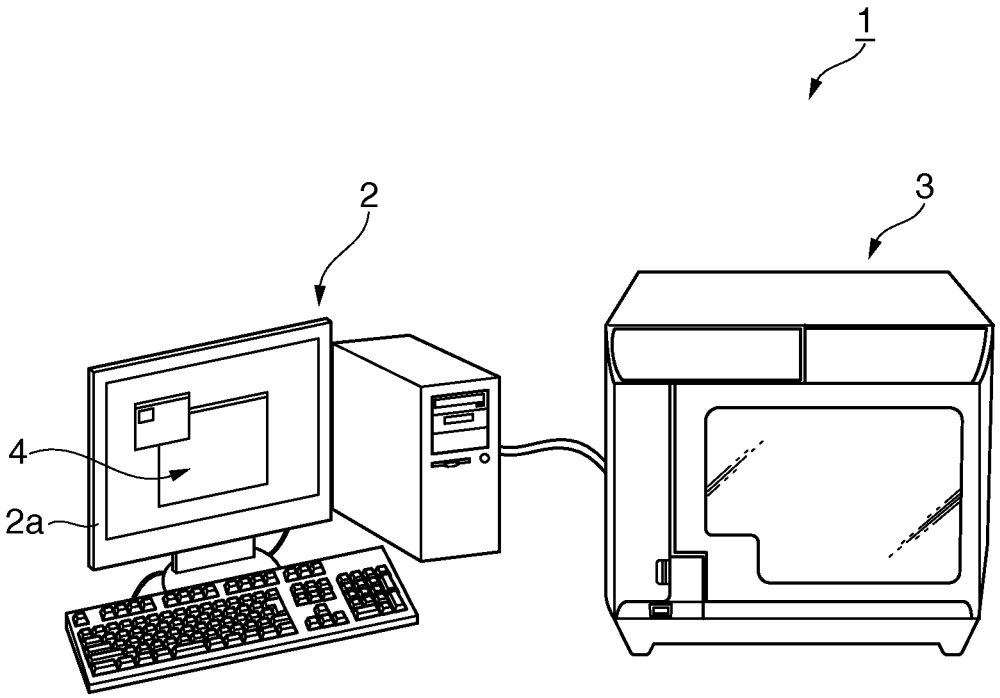
FIG. 1 is an oblique view of a media processing system according to the invention.

FIG. 1 is an oblique view of a media processing system according to a preferred embodiment of the invention.

This media processing system 1 produces CDs, DVDs, and other types of disc media 10, and includes a computer 2 with a display 2*a* and a disc publisher (media processing device) 3 that is communicably connected to the computer 2.

The computer 2 runs a software application 4 to which disc production commands are input. When a disc production command is input to the software application 4 by the operator, a disc production command is sent from the computer 2 to the disc publisher 3. When the disc publisher 3 receives a disc production command, it sequentially applies a data write process and then a label printing process to a disc 10, thereby producing a new disc 10.

Software Application

Figure 2:
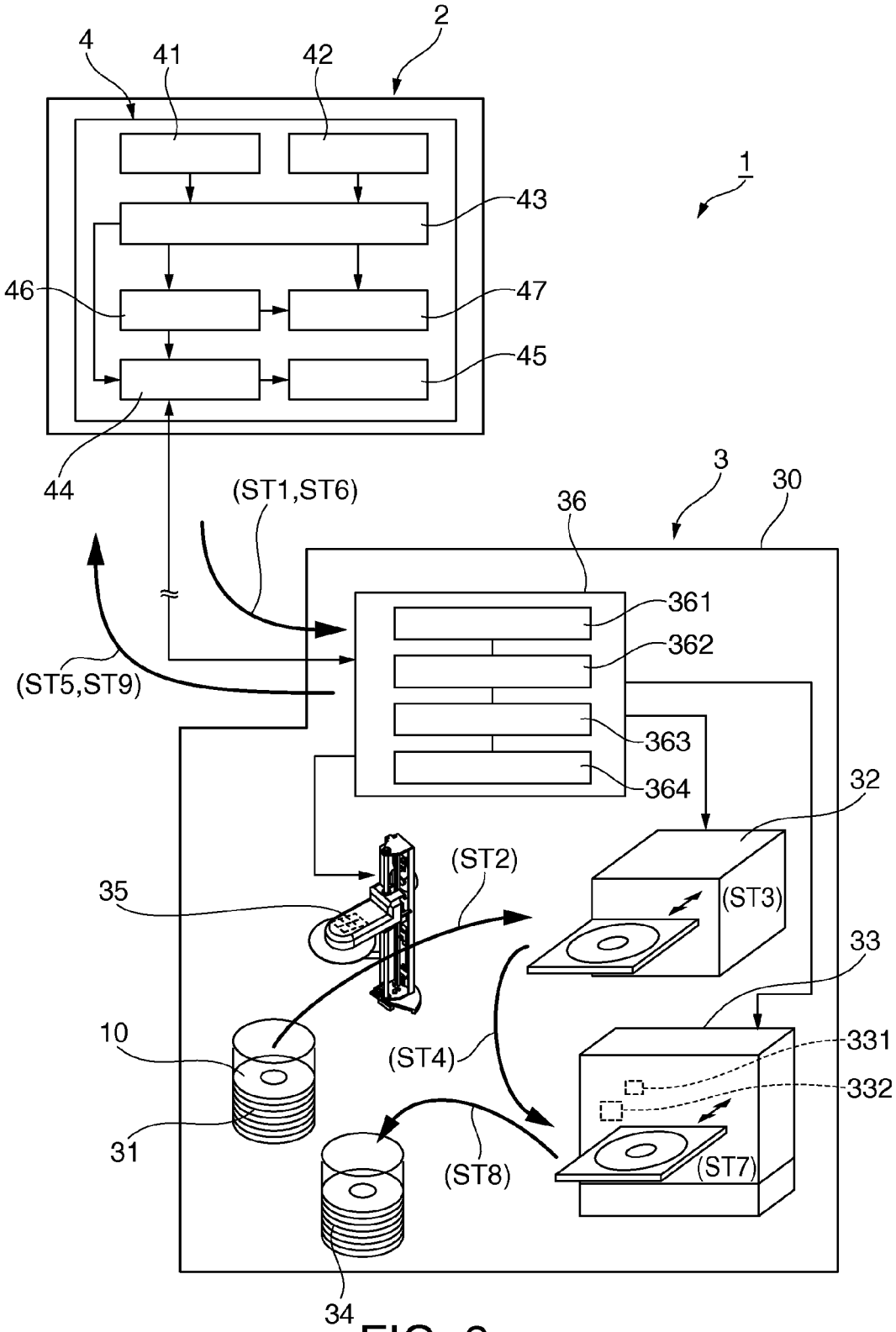
FIG. 2 is a block diagram of a media processing system according to the invention.

FIG. 2 is a block diagram of the media processing system 1. As shown in FIG. 2, the software application 4 includes a write data generator 41 that produces the write data to be written to the disc 10; a print data generator 42 that produces print data for printing a label including a title describing the content of the write data; a disc production command generator 43 that produces a disc production command for making a disc 10; a communication unit (transmission unit) 44 that sends disc production commands and other information to the disc publisher 3; and a disc completion notification unit 45 that informs the operator when a disc 10 is completed.

When a disc production command is input by the operator, the disc production command generator 43 issues a disc production command based on the supplied write data and print data. A data write command that causes the disc publisher 3 to write the write data, and a label print command that causes the disc publisher 3 to print a label, are included in the disc production command output from the disc production command generator 43. The data write command includes the write data, and the label print command includes the print data.

The software application 4 also includes a preprocessing time calculator 46 and a disc production time reporter (media production time notification unit) 47.

When a disc production command is input by the operator, the preprocessing time calculator 46 calculates the preprocessing time until the label printing process starts in the disc publisher 3. The disc production time reporter 47 calculates and reports the media production time, which is the time until the disc 10 is completed by the disc publisher 3, to the operator.

The preprocessing time calculator 46 calculates the preprocessing time based on the amount of write data produced by the write data generator 41, the write speed or how fast data is written to the disc 10 by the disc publisher 3, and the time required to transport the disc 10 inside the disc publisher 3. When the preprocessing time is calculated by the preprocessing time calculator 46, the preprocessing time is sent by the communication unit 44 to the disc publisher 3 as an argument of the cleaning evaluation command (cleaning).

The disc production time reporter 47 calculates the media production time based on the preprocessing time calculated by the preprocessing time calculator 46 and the amount of print data output by the print data generator 42. The disc production time reporter 47 reports the calculated media production time to the operator by presenting it on the display 2*a*.

When a disc production command is issued, the communication unit 44 first sends a cleaning evaluation command to the disc publisher 3. The communication unit 44 then waits for a response to the cleaning evaluation command from the disc publisher 3 indicating if cleaning is needed, and when a response is received sends the data write command to the disc publisher 3. The communication unit 44 then looks for a write process completion report from the disc publisher 3, and when the write process completion report is received, sends a label print command to the disc publisher 3. The communication unit 44 then looks for a printing process completion report from the disc publisher 3, and informs the disc completion notification unit 45 when a printing process completion report is received.

When the printing process completion report is received, the disc completion notification unit 45 informs the operator by presenting a message indicating that the disc 10 is finished on the display 2*a*. Alternatively, the user could be informed by sounding a buzzer not shown.

Disc Publisher

The disc publisher 3 has a case 30, and inside the case 30 has a disc supply stacker 31 or storing blank discs or other writable discs 10; a disc drive 32 (write mechanism) that executes the write process to write the write data to the disc 10; a label printer 33 (print mechanism) that executes a printing process to print a label on the label side of the disc 10 after the data is written; a disc discharge stacker 34 for discharging the completed discs 10 after data writing and label printing are completed; and a disc transportation mechanism 35 that conveys the discs 10 between stations inside the case 30.

The label printer 33 is an inkjet printer that uses an inkjet head as the printhead 31, and has a cleaning mechanism 332 for executing a cleaning process to clean the printhead 31. The cleaning mechanism 332 runs an ink suction operation or ink discharge operation to purge ink from the ink nozzles of the printhead 31, or a wiping operation that wipes the nozzle surface of the printhead 31.

The disc publisher 3 has a control unit 36 that controls driving other parts of the disc publisher 3. The computer 2 is connected to the input side of the control unit 36 through a communication cable or network, and when a disc production command is received from the computer 2, the control unit 36 controls driving the other parts of the disc publisher 3 to produce a disc 10. When the write process or printing process is completed, the control unit 36 sends a completion report for each process to the computer 2.

More specifically, when a data write command is received (step ST1), the control unit 36 controls driving the disc transportation mechanism 35 to convey a disc 10 from the disc supply stacker 31 to the disc drive 32 (step ST2). The control unit 36 then controls driving the disc drive 32 to write data to the disc 10 (step ST3). When the write process is completed, the control unit 36 controls driving the disc transportation mechanism 35 to convey the written disc 10 from the disc drive 32 to the label printer 33 (step ST4). The control unit 36 then sends a write process completion report to the computer 2 (step ST5).

When the software application 4 receives the write process completion report that was sent from the computer 2, the software application 4 sends a label print command to the disc publisher 3. When this label print command is received (step ST6), the control unit 36 controls driving the label printer 33 to print a label on the disc 10 (step ST7). When printing the label is completed, the control unit 36 controls driving the disc transportation mechanism 35 to convey the finished disc 10 from the label printer 33 to the disc discharge stacker 34 (step ST8). A printing process completion report is then sent to the computer 2 (step ST9).

The control unit 36 has a counter 361 that counts the time passed since completion of the last cleaning process each time a cleaning process is performed in the label printer 33. The counter 361 is a timer that resets each time the cleaning process is performed.

The control unit 36 also has a total time calculator 362, decision unit 363, and cleaning control unit 364.

When a cleaning evaluation command is received from the computer 2, the total time calculator 362 calculates the total time by adding the preprocessing time received as an argument and the elapsed time counted by the counter 361.

The decision unit 363 determines whether or not cleaning is needed based on the total time, and returns the resulting decision as the response to the computer 2.

The cleaning control unit 364 controls driving the cleaning mechanism 332 of the label printer 33.

When the total time is calculated by the total time calculator 362, the decision unit 363 determines whether or not this total time is greater than or equal to a specified time at which cleaning is required, and determines that the cleaning process is needed when this specified time is reached.

If the total time is less than the specified time, the decision unit 363 determines that cleaning is not needed.

The result of this decision is sent to the computer 2 as an argument of the cleaning evaluation command.

The specified time at which cleaning becomes necessary is a predetermined time that is set to perform the cleaning process regularly, and in this embodiment of the invention is five hours.

The cleaning control unit 364 controls driving the cleaning mechanism 332 and starts the cleaning process when the decision unit 363 determines that the cleaning process is needed.

Media Production Operation

Figure 3:
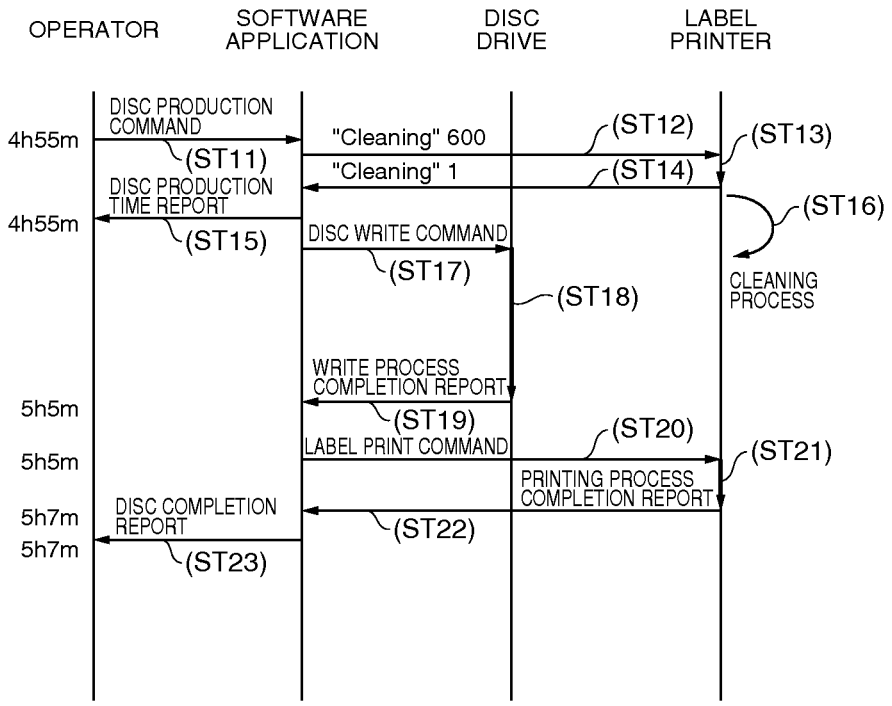
FIG. 3 is a state transition diagram showing the media production operation of the media processing system according to the invention.

FIG. 3 shows the media production operation of the disc publisher 3. A situation in which the printhead 31 cleaning process is executed between when a disc production command is output and the disc 10 is produced is described below with reference to FIG. 3.

The specified time at which a cleaning process is required is set to 5 hours in this example. The operator has also already used the software application 4 to create the write data and print data.

As shown in FIG. 3, operation starts when the operator inputs a disc production command to the software application 4 (step ST11). The disc production command is input in this example 4 hours and 55 minutes after the last cleaning process. As a result, a disc production command is output from the software application 4.

When the disc production command is input, the preprocessing time calculator 46 of the software application 4 calculates the preprocessing time. When the preprocessing time is calculated, the communication unit 44 sends the preprocessing time as an argument of the cleaning evaluation command (cleaning) to the disc publisher 3 (step ST12). In this example the preprocessing time is calculated from the amount of write data and other factors to be 10 minutes (600 seconds).

When the disc publisher 3 receives a cleaning evaluation command, the total time calculator 362 of the control unit 36 adds the preprocessing time and the time elapsed since the last cleaning process to calculate the total time, and the decision unit 363 determines whether or not the cleaning process is necessary (step ST13) based on the total time. In this example the total time is 5 hours 5 minutes and exceeds the specified time (5 hours) for regularly performing the cleaning process. The cleaning process is therefore determined necessary.

The result of this decision by the decision unit 363 is then sent to the computer 2 as the response to the cleaning evaluation command (step ST14). Because the cleaning process is determined necessary in this example, a 1 meaning necessary is passed as the result of the cleaning evaluation command. Note that if the cleaning process is determined to not be needed, a 0 meaning unnecessary is passed as the result of the cleaning evaluation command.

The software application 4 then presents the media production time calculated by the disc production time reporter 47 on the display 2*a* (step ST15). In this example the media production time is calculated to be 12 minutes based on the amount of write data and the amount of print data. More specifically, the preprocessing time until the printing process starts is 10 minutes, the post-processing time to output of the disc 10 after the printing process starts is 2 minutes, and the media production time is therefore calculated to be 12 minutes.

Because the cleaning process was determined necessary in step ST13 in this example, the cleaning control unit 364 controls driving the cleaning mechanism 332 to start the cleaning process (step ST16). The time required for the cleaning process is 2 minutes.

When the software application 4 receives the response to the cleaning evaluation command, it sends a data write command to the disc publisher 3 (step ST17).

When the disc publisher 3 receives a data write command, the control unit 36 controls driving the disc drive 32 to write data to the disc 10 (step ST18). When the write process ends, the written disc 10 is conveyed to the label printer 33 and a write process completion report is sent to the computer 2 (step ST19). In this example the write process completion report is sent 5 hours 5 minutes after the last cleaning process.

When the write process completion report is received, the software application 4 sends a label print command to the disc publisher 3 (step ST20).

When the disc publisher 3 receives the label print command, the control unit 36 controls driving the label printer 33 to print a label on the disc 10 (step ST21). When the printing process ends, the written disc 10 is conveyed to the disc discharge stacker 34, and a printing process completion report is sent to the computer 2 (step ST22). In this example the printing process completion report is issued 5 hours 7 minutes after the last cleaning process.

When the software application 4 receives the printing process completion report, the disc completion notification unit 45 presents a message indicating that the disc 10 was completed on the display 2*a* to inform the operator (step ST23).

In this example the printing process completion report is issued 5 hours 7 minutes after the last cleaning process and 12 minutes after the disc production command was issued. More specifically, it is the same as the media production time displayed by the disc production time reporter 47 on the display 2*a* in step ST15.

Operating Effect

The software application 4 in a media processing system 1 according to the related art does not have a preprocessing time calculator 46. The disc publisher 3 also does not have a total time calculator 362, and the decision unit 363 determines that the cleaning process is not needed unless the elapsed time counted by the counter 361 is greater than or equal to the specified time (5 hours) that is set as the elapsed time from the last cleaning process. When the time passed since the last cleaning process is greater than or equal to the preset specified time (5 hours) and a label print command is received, the cleaning control unit 364 starts the cleaning process as an interrupt process before running the label printing process.

As a result, the printhead 31 cleaning process is executed as an interrupt process in a media processing system 1 according to the related art the first time a printing process starts after the specified time from the last cleaning process has passed. The cleaning process is therefore executed as an interrupt process after completion of the write process when the time passed from the last cleaning process reaches the specified time after a media production command is issued and before the printing process starts. Because the printing process waits until the cleaning process ends, the media production time is increased by the time required to perform the cleaning process.

Figure 4:
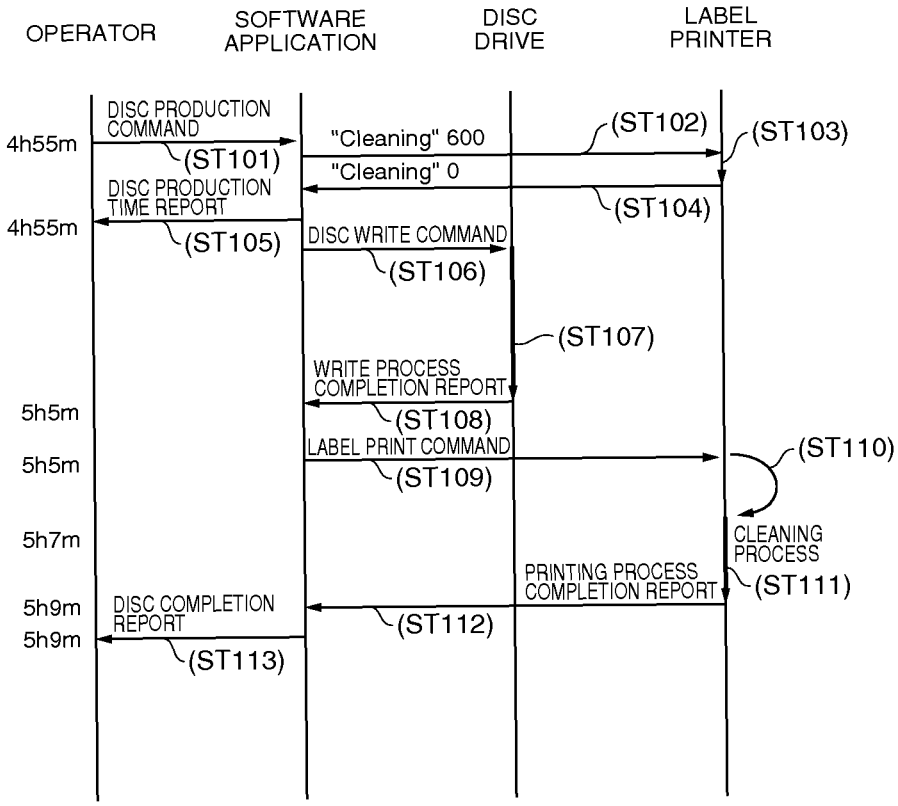
FIG. 4 is a state transition diagram showing the media production operation of the media processing system according to the related art.

The printhead 31 cleaning operation in a media processing system according to the related art is described next with reference to FIG. 4. FIG. 4 shows the media production operation in the media processing system according to the related art.

The specified time at which a cleaning process is necessary is also set to 5 hours in the example shown in FIG. 4. The operator has also already used the software application 4 to create the write data and print data.

As in the example shown in FIG. 3, the software application 4 is operated and a disc production command is input 4 hours and 55 minutes after the last cleaning process (step ST101).

When a disc production command is input and a disc production command is asserted by the software application 4, the communication unit 44 sends a cleaning evaluation command (cleaning) to the disc publisher 3 (step ST102). Because the media processing system according to the related art does not have a preprocessing time calculator 46, the preprocessing time is not passed as an argument of the cleaning evaluation command.

When the disc publisher 3 receives a cleaning evaluation command, the decision unit 363 determines whether or not the cleaning process is necessary based on whether or not the elapsed time counted by the counter 361 is greater than or equal to the specified time. Because the elapsed time in the example shown in FIG. 4 is 4 hours 55 minutes, the elapsed time has still not reached the specified time (5 hours). The decision unit 363 therefore determines that the cleaning process is not necessary (step ST103).

After the decision unit 363 decides, the result is sent as a response to the cleaning evaluation command to the computer 2 (step ST104). Because the cleaning process is determined to be not necessary in the example shown in FIG. 4, a 0 meaning the cleaning process is not necessary is passed as an argument of the response to the cleaning evaluation command.

The software application 4 then displays the media production time calculated by the disc production time reporter 47 on the display 2*a* (step ST105). In the example shown in FIG. 4 the media production time is calculated to be 12 minutes based on the amount of write data and the amount of print data. More specifically, the preprocessing time until the printing process starts is 10 minutes, the post-processing time to output of the disc 10 after the printing process starts is 2 minutes, and the media production time is therefore calculated to be 12 minutes.

When the cleaning requirement response is received, the software application 4 sends a data write command to the disc publisher 3 (step ST106).

When the disc publisher 3 receives a data write command, the control unit 36 controls driving the disc drive 32 to write data to the disc 10 (step ST107). When the write process ends, the written disc 10 is conveyed to the label printer 33 and a write process completion report is sent to the computer 2 (step ST108). In the example shown in FIG. 4, the write process completion report is sent 5 hours 5 minutes after the last cleaning process.

When the write process completion report is received, the software application 4 sends a label print command to the disc publisher 3 (step ST109).

When the disc publisher 3 receives the label print command, the control unit 36 starts the printing process. However, the elapsed time when the label print command was received is 5 hours 5 minutes. More specifically, the time passed since the last cleaning process was performed is greater than or equal to the preset specified time (5 hours) at which the cleaning process is required. The cleaning control unit 364 therefore starts the cleaning process as an interrupt process before running the printing process to print a label (step ST110). The cleaning process takes 2 minutes.

The printing process runs when the cleaning process ends (step ST111). When the printing process then ends, the written disc is conveyed to the disc discharge stacker 34, and a printing process completion report is sent to the computer 2 (step ST112). In the example shown in FIG. 4, the printing process completion report is output 5 minutes 9 minutes after the last cleaning process.

When the software application 4 receives the printing process completion report, the disc completion notification unit 45 presents a message indicating that the disc 10 was completed on the display 2*a* to inform the operator (step ST113).

In the example shown in FIG. 4 the printing process completion report is issued 5 hours 9 minutes after the last cleaning process and 14 minutes after the disc production command was issued. More specifically, the actual media production time is 2 minutes (the time required for the cleaning process) longer than the media production time displayed by the disc production time reporter 47 on the display 2*a* in step ST105.

As described above, when the time passed since the last cleaning process reaches a specified time between when the disc production command is asserted and the printing process starts in the media processing system according to the related art, the disc production time increases by the time required for the cleaning process in step ST110.

With the media processing system according to the invention described above as shown in FIG. 3, however, when a disc production command is input to the software application 4, the software application 4 calculates and sends the preprocessing time until the printing process starts to the disc publisher 3. When disc publisher 3 receives the preprocessing time and determines that the sum of the elapsed time and the preprocessing time is greater than or equal to the specified time, it starts the cleaning process. The write process (step ST18) and the cleaning process (step ST16) are therefore executed at the same time if the time elapsed since last cleaning process will reach the specified time after the disc production command is received and before the printing process starts. As a result, because executing the cleaning process as an interrupt process after the write process ends and delaying the start of the printing process is avoided, increasing the media production time by the time required for the cleaning process can be prevented.

Because the media processing system 1 according to this embodiment of the invention can reduce the difference between the media production time calculated based on the disc production command and the time actually required to produce the media, the disc production time reporter 47 can report the media production time to the operator with great accuracy.

Other Embodiments

The software application 4 in the embodiment described above has a disc completion notification unit 45, preprocessing time calculator 46, communication unit 44, and disc production time reporter 47. Alternatively, the software application 4 could invoke a device driver 5 in the computer 2 that controls driving the disc publisher 3, and the disc completion notification unit 45, preprocessing time calculator 46, communication unit 44 (second communication unit), and disc production time reporter 47 could be rendered in the device driver 5.

Figure 5:
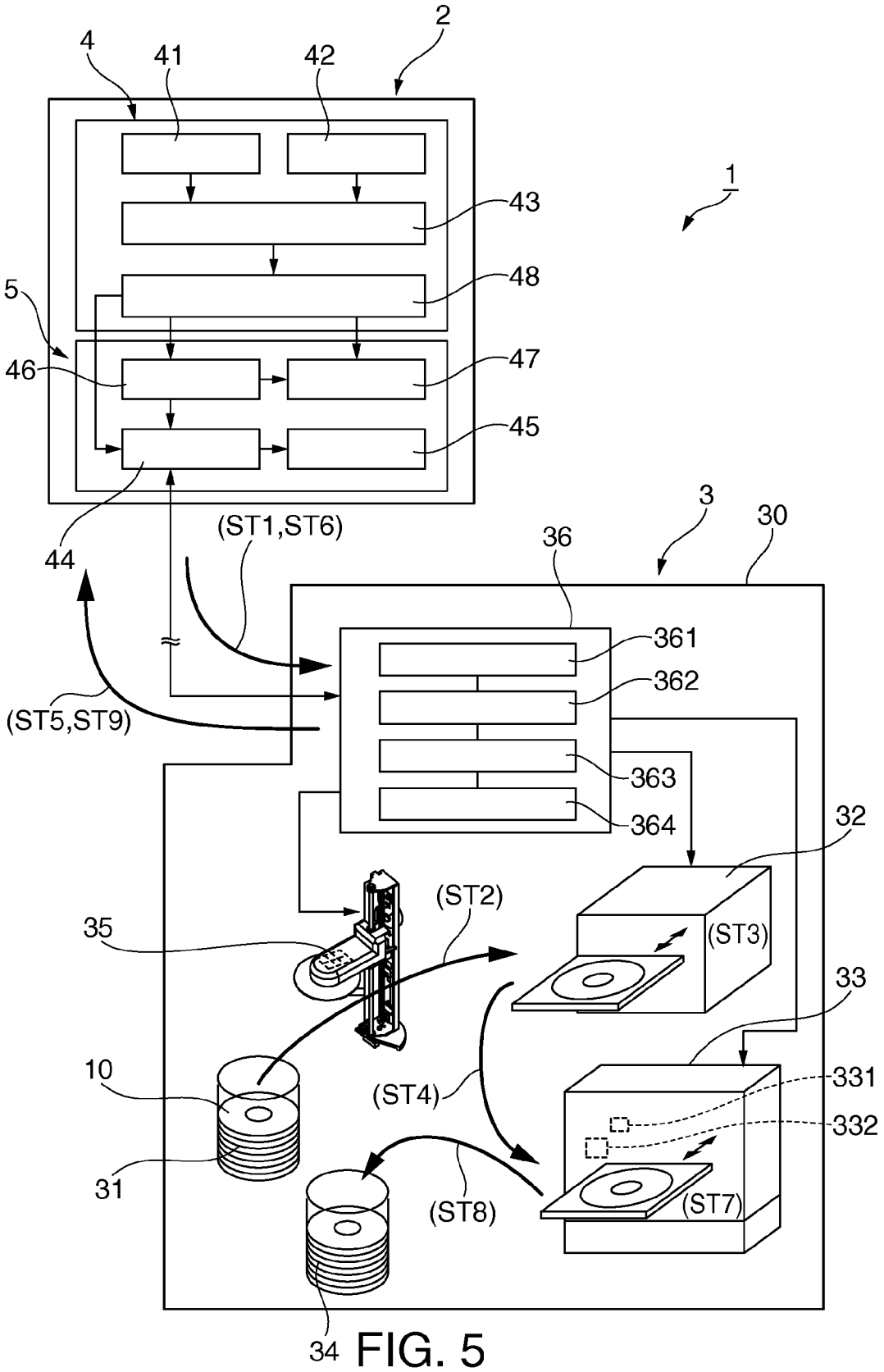
FIG. 5 is a block diagram of a media processing system according to another embodiment of the invention.

In this configuration, as shown in FIG. 5, the software application 4 includes the write data generator 41, print data generator 42, disc production command generator 43, and a communication unit 48 (first communication unit) that handles communication between the software application 4 and the device driver 5. The communication unit 48 of the software application 4 in this configuration sends disc production commands generated by the software application 4 to the device driver 5, and the preprocessing time calculator 46 of the device driver 5 receives the disc production command from the software application 4 and calculates the preprocessing time based on the disc production command.

The preprocessing time calculator 46 is disposed on the side of the computer 2 in the foregoing embodiment, but the preprocessing time calculator 46 may be rendered in the control unit 36 of the disc publisher 3. When the control unit 36 of the disc publisher 3 in this case receives disc production commands from the computer 2, the preprocessing time calculator 46 calculates the preprocessing time based on the amount of write data contained in the data write command, for example, and sends the calculated preprocessing time to the decision unit 363.

The counter 361, total time calculator 362, and decision unit 363 are rendered on the side of the disc publisher 3 in the embodiment described above, but instead could be rendered on the computer 2 side and control driving the cleaning mechanism 332 from the computer 2 side.

The invention is applied to a media processing system 1 including a computer 2 and a disc publisher 3 in the embodiment described above, but the invention can also be applied to a disc publisher 3 that is used as a stand-alone device.

For example, the invention can be applied to a disc publisher 3 that by operating switches disposed to the case 30 runs a write process to write data and a printing process to print a label on discs 10 using write data and print data that are previously stored in a storage unit disposed in the case 30. In this configuration disc production commands are input by a switch operation, and the counter 361, preprocessing time calculator 46, total time calculator 362, 263, and cleaning control unit 364 are disposed to the control unit 36 of the disc publisher 3.

When a disc production command is input, the preprocessing time calculator 46 calculates the preprocessing time to the start of the printing process based on the write data stored in the storage unit, and sends the calculated preprocessing time to the total time calculator 362. The total time calculator 362 sends the calculated total time to the decision unit 363. The decision unit 363 determines if a cleaning process is necessary when the preprocessing time is received, and the cleaning control unit 364 starts the cleaning process based on the decision from the decision unit 363.

The data write process and the cleaning process are also performed in parallel in this case if the time elapsed since the last cleaning process will reach a predetermined time between when the disc production command is asserted and the printing process starts. Because delaying the start of the printing process as a result of executing the cleaning process as an interrupt process after the data write process ends can thus be avoided, increasing the media production time by the time required to run the cleaning process can be prevented.

A disc publisher 3 is used to produce media in the foregoing embodiments, but the invention can also be applied to media processing devices that produce media by sequentially executing a first process not accompanied by a printing operation and then executing a second process accompanied by a printing operation. For example, the invention can also be applied to a media processing device rendered as a photocopier that executes a scanning process as the first process to read image data from paper media using a scanner, and executes a printing process as the second process to print the scanned image data to paper media, for example.

When the invention is applied to a photocopier, media production commands are input by operating a switch disposed to the photocopier, and the counter 361, preprocessing time calculator 46, total time calculator 362, decision unit 363, and cleaning control unit 364 are rendered in the control unit of the photocopier. When a media production command is input, the preprocessing time calculator 46 calculates the preprocessing time until the second process starts based on the size and number of paper media to be read by the scanner, and sends the calculated preprocessing time to the total time calculator 362. The total time calculator 362 sends the calculated total time to the decision unit 363. When the preprocessing time is received, the decision unit 363 determines whether or not a cleaning process is needed, and the cleaning control unit 364 starts the cleaning process based on the decision from the decision unit 363.

The data reading process and the cleaning process are also performed in parallel in this case if the time elapsed since the last cleaning process will reach a predetermined time between when the disc production command is asserted and the printing process starts. Because delaying the start of the printing process as a result of executing the cleaning process as an interrupt process after the data reading process ends can thus be avoided, increasing the media production time by the time required to run the cleaning process can be prevented.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A drive control method for a media processing device that produces media when a media production command is input by sequentially executing a first process not accompanied by a printing operation that prints on media using a printhead, then executing a second process accompanied by the printing operation, the drive control method comprising steps of:

calculating a preprocessing time, which is the time until the second process starts, based on the media production command, when the media production command is input;

calculating a total time as the sum of the preprocessing time and the time elapsed since the last cleaning process performed on the printhead;

determining if the total time is greater than or equal to a preset specified time at which a new cleaning process is necessary; and starting the cleaning process if the total time is greater than or equal to the specified time.

2. The drive control method for a media processing device described in claim 1, further comprising a step of:

calculating and reporting a media production time, which is the time required to produce the media based on the media production command, to an operator when the media production command is input.

3. The drive control method for a media processing device described in claim 1, wherein:

the first process includes a write process that writes data to the media; and the second process includes a printing process that prints a label on the media.

4. The drive control method for a media processing device described in claim 3, further comprising steps of:

inputting the media production command to a computer that is communicably connected to the media processing device;

calculating the preprocessing time on the computer;

supplying the media production command and the preprocessing time from the computer to the media processing device; and calculating the total time and determining if the total time is greater than or equal to the specified time on the media processing device.

5. The drive control method for a media processing device described in claim 1, wherein:

the first process includes a read process that reads image data using a scanner; and the second process includes a printing process that prints on the media based on the scanned image data.

6. A media processing system comprising:

a media processing device that has a write mechanism for executing a write process to write data on media, and a printing mechanism for executing a printing process to print a label on the media using a printhead, and sequentially executes and applies the write process and then the printing process to the media when a media production command is received;

a computer that is communicably connected to the media processing device; and a software application that runs on the computer, receives the media production command, when the media production command is input, calculates a preprocessing time to when the printing process starts, and sends the media production command and preprocessing time to the media processing device after the preprocessing time is calculated; and wherein the media processing device performs a cleaning process that cleans the printhead, counts elapsed time from completion of the cleaning process every time the cleaning process is performed, calculates a total time as the sum of the elapsed time and the preprocessing time when the preprocessing time is received, after the total time is calculated, determines if the total time is greater than or equal to a preset specified time at which the cleaning process is required, and controls driving the cleaning mechanism, and starts the cleaning process if the total time is determined to be greater than or equal to the specified time.

7. The media processing system described in claim 6, wherein:

the software application calculates a media production time required to produce the media when the media production command is input, and reports the media production time to an operator.

8. A media processing system comprising:

a media processing device that has a write mechanism for executing a write process to write data on media, and a printing mechanism for executing a printing process to print a label on the media using a printhead, and sequentially executes and applies the write process and then the printing process to the media when a media production command is received;

a computer that is communicably connected to the media processing device;

a software application that runs on the computer and receives the media production command; and a software driver that runs on the computer and controls driving the media processing device based on the media production command;

wherein the software application sends the media production command to the software driver when the media production command is input;

wherein the software driver when the media production command is received, calculates a preprocessing time to when the printing process starts based on the media production command, and sends the media production command and the preprocessing time to the media processing device after the preprocessing time is calculated; and wherein the media processing device performs a cleaning process that cleans the printhead, counts elapsed time from completion of the cleaning process every time the cleaning process is performed, calculates a total time as the sum of the elapsed time and the preprocessing time when the preprocessing time is received, after the total time is calculated, determines if the total time is greater than or equal to a preset specified time at which the cleaning process is required, and controls driving the cleaning mechanism, and starts the cleaning process if the total time is determined to be greater than or equal to the specified time.

9. The media processing system described in claim 8, wherein:

the software driver calculates a media production time required to produce the media based on the media production command when the media production command is input, and reports the media production time to an operator.

* * * * *